US007518076B1

(12) United States Patent
Gottschalk et al.

(10) Patent No.: US 7,518,076 B1
(45) Date of Patent: Apr. 14, 2009

(54) ELECTRICAL SWITCHING APPARATUS, AND CHARGING ASSEMBLY AND INTERLOCK ASSEMBLY THEREFOR

(75) Inventors: Andrew L. Gottschalk, Pittsburgh, PA (US); Paul R. Rakus, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/060,585

(22) Filed: Apr. 1, 2008

(51) Int. Cl.
*H01H 5/00* (2006.01)

(52) U.S. Cl. ..... 200/400; 200/401; 335/16

(58) Field of Classification Search ..... 200/400, 200/401, 500, 331; 335/16, 17, 20–22
See application file for complete search history.

(56) References Cited

U.S. PATENT DOCUMENTS 5,274,206 A 12/1993 Milianowicz
5,280,258 A * 1/1994 Opperthauser ..... 335/172
5,901,838 A * 5/1999 Nakatani et al. ..... 200/400
5,938,008 A * 8/1999 Wehrli et al. ..... 200/400
6,015,959 A 1/2000 Slepian et al.
6,064,021 A 5/2000 Wehrli et al.
6,160,234 A 12/2000 Wehrli, III et al.

* cited by examiner

*Primary Examiner*—Kyung Lee
(74) *Attorney, Agent, or Firm*—Martin J. Moran

(57) ABSTRACT

An interlock assembly is provided for a circuit breaker charging assembly. The charging assembly includes a cam shaft, a latch mechanism, such as a D-shaft, a latch assembly, and a charging handle. The charging handle pivots the cam shaft. The D-shaft is pivotable between first and second positions corresponding to the D-shaft latching and unlatching the latch assembly, respectively. The interlock assembly includes a lever coupled to and pivotable with the D-shaft, and a latch interlock pivotably coupled to the circuit breaker housing. The latch interlock moves between locked and unlocked positions corresponding respectively to the first end of the latch interlock moving the lever to position the D-shaft in the second position and the first position. Unless and until the stored energy mechanism is substantially fully charged, the latch interlock is disposed in the locked position and the latch assembly is movable with respect to the D-shaft.

22 Claims, 4 Drawing Sheets

ELECTRICAL SWITCHING APPARATUS, AND CHARGING ASSEMBLY AND INTERLOCK ASSEMBLY THEREFOR

BACKGROUND OF THE INVENTION

1. Field of the Invention

The invention relates generally to electrical switching apparatus and, more particularly, to electrical switching apparatus, such as circuit breakers. The invention also relates to charging assemblies for electrical switching apparatus. The invention further relates to interlock assemblies for the charging assemblies of electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a pole shaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the pole shaft. Elements of both the closing assembly and the opening assembly, which are also pivotably coupled to the pole shaft, pivot the pole shaft in order to effectuate the closing and opening of the electrical contacts.

The force required to close the electrical contacts of some low and medium voltage circuit breakers, for example, is greater than what a human can typically provide. For this and other reasons, known closing assemblies typically include at least one stored energy mechanism such as, for example and without limitation, a number of closing springs, to facilitate the closing process. More specifically, the closing spring(s) can be charged either automatically, for example, using an electric motor, or manually, for example, by operating a charging handle that is accessible from the exterior of the circuit breaker housing for this purpose. The charging handle is part of a charging assembly for charging the closing spring (s).

During the manual charging operation, the possibility exists that the charging handle could be unintentionally released (e.g., without limitation, accidently dropped). Under such circumstances, depending on the position of the charging handle, energy that has already been stored (e.g., closing spring(s) partially charged) could be suddenly released, causing damage to one or more components of the closing assembly and/or charging assembly.

There is, therefore, room for improvement in electrical switching apparatus, such as circuit breakers, and in charging assemblies and interlock assemblies therefor.

SUMMARY OF THE INVENTION

These needs and others are met by embodiments of the invention, which are directed to an interlock assembly for the charging assembly of an electrical switching apparatus, such as a circuit breaker. The interlock assembly resists damage potentially caused by the unintentional release of energy stored in the stored energy mechanism (e.g., without limitation, closing spring(s)) of the closing assembly, for example and without limitation, in the event the charging handle of the charging assembly is unintentionally released (e.g., without limitation, accidentally dropped) while an operator is manually charging the circuit breaker.

As one aspect of the invention, an interlock assembly is provided for a charging assembly of an electrical switching apparatus. The electrical switching apparatus includes a housing, separable contacts enclosed by the housing, and an operating mechanism structured to open and close the separable contacts. The operating mechanism includes a stored energy mechanism. The charging assembly includes a cam shaft, a latch mechanism, a latch assembly and a charging handle. The charging handle is structured to pivot the cam shaft, and the cam shaft is structured to move the latch assembly in order to charge and discharge the stored energy mechanism. The latch mechanism is movable between a first position corresponding to the latch mechanism latching the latch assembly, and a second position corresponding to the latch mechanism unlatching the latch assembly. The interlock assembly comprises: a lever structured to be coupled to and move with the latch mechanism of the charging assembly; and a latch interlock structured to be pivotably coupled to the housing of the electrical switching apparatus, the latch interlock comprising a first end and a second end disposed opposite and distal from the first end, the latch interlock being movable between a locked position corresponding to the first end of the latch interlock being structured to move the lever to position the latch mechanism in the second position, and an unlocked position corresponding to the first end of the latch interlock being structured to move the lever to position the latch mechanism in the first position. Unless and until the stored energy mechanism is substantially fully charged, the latch interlock is structured to be disposed in the locked position, in order that the latch assembly is movable with respect to the latch mechanism.

The latch interlock may further comprise a biasing element, wherein the biasing element biases the latch interlock toward the locked position. The latch interlock may further comprise a pivot pin and a protrusion, wherein the pivot pin is structured to pivotably couple the latch interlock to the housing of the electrical switching apparatus, and wherein the protrusion extends outwardly from the latch interlock between the first end of the latch interlock and the second end of the latch interlock. The bias element may be a spring. The spring may include a first end and a second end disposed opposite and distal from the first end of the spring, wherein the first end of the spring is coupled to the protrusion of the latch interlock, and wherein the second end of the spring is structured to be coupled to the housing of the electrical switching apparatus. The spring may be structured to bias the latch interlock about the pivot pin. The latch interlock may further comprise a slot, wherein the pivot pin is movably disposed in the slot, in order that the latch interlock is structured to be pivotable and translatable with respect to the housing of the electrical switching apparatus.

The latch mechanism may be a D-shaft, wherein the D-shaft is pivotable between the first position and the second position. The lever may comprise a mounting portion and an arcuate portion extending outwardly from the mounting portion. The mounting portion may be structured to be coupled to the D-shaft, and the arcuate portion may have a concave surface and a convex surface disposed opposite the concave surface. The first end of the latch interlock may be structured to cooperate with the concave surface of the arcuate portion of the lever, in order to move the D-shaft between the first position and the second position. The first end of the latch interlock may comprise an arcuate hook, wherein the arcuate hook extends toward the lever.

As another aspect of the invention, a charging assembly is provided for an electrical switching apparatus. The electrical switching apparatus includes a housing, separable contacts enclosed by the housing, and an operating mechanism structured to open and close the separable contacts. The operating mechanism includes a stored energy mechanism. The charging assembly comprises: a latch assembly; a latch mechanism structured to be movably coupled to the housing of the electrical switching apparatus, the latch mechanism being movable between a first position corresponding to the latch mechanism latching the latch assembly, and a second position corresponding to the latch mechanism unlatching the latch assembly; a cam shaft structured to move the latch assembly in order to charge and discharge the stored energy mechanism; a charging handle coupled to the cam shaft, the charging handle being structured to pivot the cam shaft; and an interlock assembly comprising: a lever coupled to and movable with the latch mechanism of the charging assembly, and a latch interlock structured to be pivotably coupled to the housing of the electrical switching apparatus, the latch interlock comprising a first end and a second end disposed opposite and distal from the first end, the latch interlock being movable between a locked position corresponding to the first end of the latch interlock moving the lever to position the latch mechanism in the second position, and an unlocked position corresponding to the first end of the latch interlock moving the lever to position the latch mechanism in the first position. Unless and until the stored energy mechanism is substantially fully charged, the latch interlock is disposed in the locked position, in order that the latch assembly is movable with respect to the latch mechanism.

The latch interlock may further comprise a contact edge, wherein the contact edge is structured to cooperate with a portion of the stored energy mechanism, in order to pivot the latch interlock toward the unlocked position. The latch assembly may comprise a close prop and a roller, wherein the close prop cooperates with the D-shaft, and wherein the roller is pivotably coupled to the close prop. The cam shaft may comprise a latch lobe, wherein the latch lobe cooperates with the roller. When the interlock assembly is disposed in the locked position, the close prop may be pivotable with respect to the D-shaft, in order to resist positive engagement between the close prop and the latch lobe.

As another aspect of the invention, an electrical switching apparatus comprises: a housing; separable contacts enclosed by the housing; an operating mechanism structured to open and close the separable contacts, the operating mechanism including a stored energy mechanism; and a charging assembly for charging the stored energy mechanism, the charging assembly comprising: a latch assembly, a latch mechanism movably coupled to the housing of the electrical switching apparatus, the latch mechanism being movable between a first position corresponding to the latch mechanism latching the latch assembly, and a second position corresponding to the latch mechanism unlatching the latch assembly, a cam shaft moving the latch assembly in order to charge and discharge the stored energy mechanism, a charging handle coupled to the cam shaft, the charging handle being structured to pivot the cam shaft, and an interlock assembly comprising: a lever coupled to and movable with the latch mechanism of the charging assembly, and a latch interlock pivotably coupled to the housing of the electrical switching apparatus, the latch interlock comprising a first end and a second end disposed opposite and distal from the first end, the latch interlock being movable between a locked position corresponding to the first end of the latch interlock moving the lever to position the latch mechanism in the second position, and an unlocked position corresponding to the first end of the latch interlock moving the lever to position the latch mechanism in the first position. Unless and until the stored energy mechanism is substantially fully charged, the latch interlock is disposed in the locked position, in order that the latch assembly is movable with respect to the latch mechanism.

The at least one side sheet of the housing may be a first side sheet and a second side sheet disposed opposite and spaced apart from the first side sheet. Each of the first side sheet and the second side sheet may include a first side and a second side disposed opposite the first side, wherein the stored energy mechanism and the latch assembly are disposed on the second side of the second side sheet substantially between the first side sheet and the second side sheet, and wherein the interlock assembly is substantially disposed on the first side of the second side sheet. The D-shaft may include a first end pivotably coupled to the first side sheet, and a second end pivotably coupled to the second side sheet, and the lever of the interlock assembly may be coupled to the D-shaft at or about the first side of the second side sheet.

The electrical switching apparatus may be a circuit breaker. The second end of the latch interlock of the interlock assembly may include a tab. The tab may protrude perpendicularly outwardly from the latch interlock. The operating mechanism of the circuit breaker may include a release member. When the stored energy mechanism is fully charged and the housing of the circuit breaker is moved in a predetermined manner, the release member may engage the tab of the latch interlock, thereby translating the latch interlock and discharging the stored energy mechanism.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
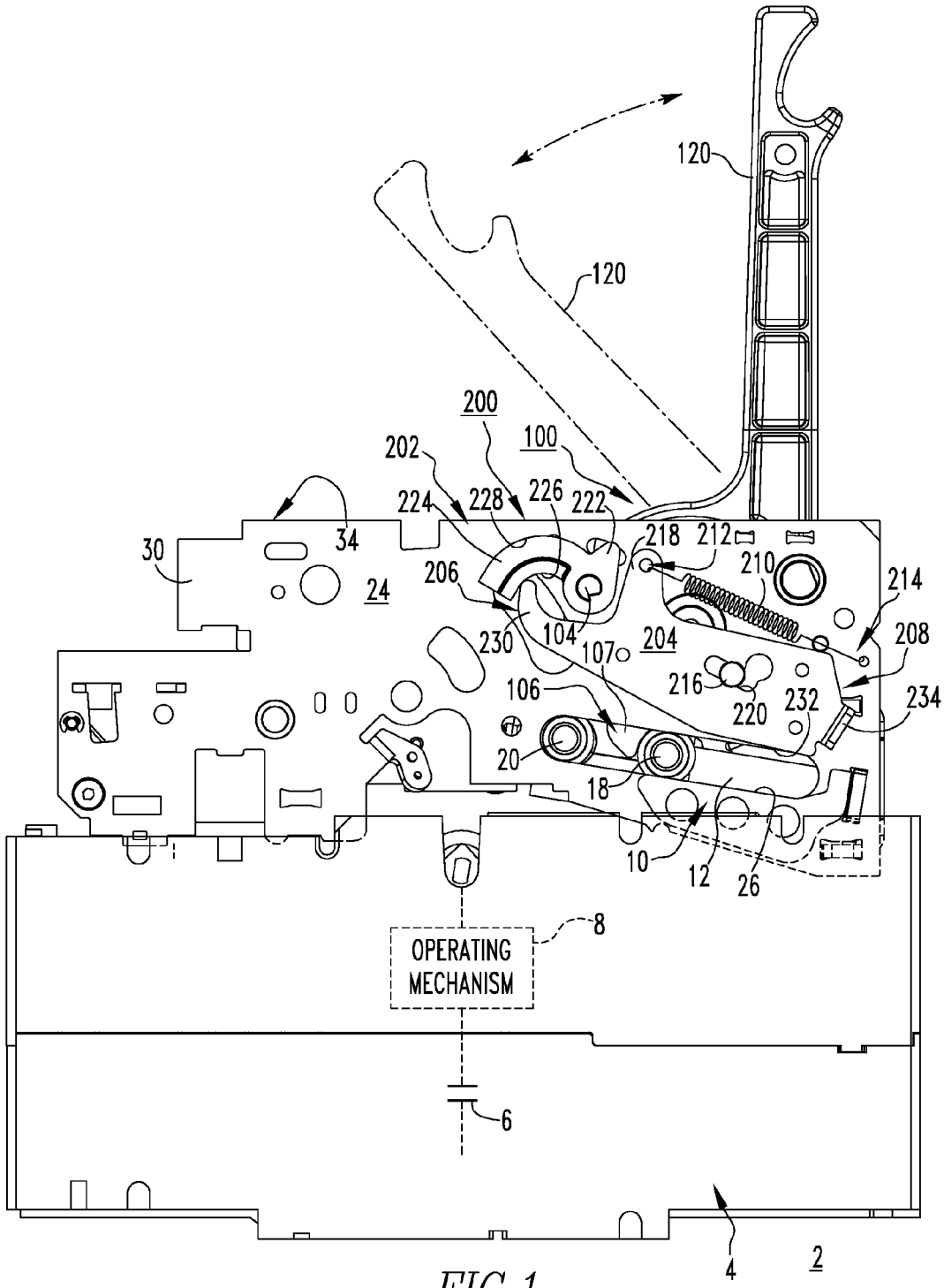
FIG. 1 is a side elevation view of a circuit breaker, and a charging assembly and an interlock assembly therefor, in accordance with an embodiment of the invention.

For purposes of illustration, embodiments of the invention will be described as applied to medium and low voltage circuit breakers, although it will become apparent that they could also be applied to the charging assemblies of any known or suitable electrical switching apparatus (e.g., without limitation, circuit switching devices and circuit interrupters such as circuit breakers other than medium and low voltage circuit breakers, network protectors, contractors, motor starters, motor controllers and other load controllers).

Directional phrases used herein, such as, for example, clockwise, counterclockwise, left, right, top, bottom, up, down and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an interlock assembly 200 for a charging assembly 100 of an electrical switching apparatus, such as a circuit breaker 2. The circuit breaker 2 generally includes a housing 4, separable contacts 6 (shown in simplified form in hidden line drawing in FIG. 1) enclosed by the housing 4, and an operating mechanism 8 (shown in simplified form in hidden line drawing in FIG. 1) structured to open and close the separable contacts 6.

Figure 2:
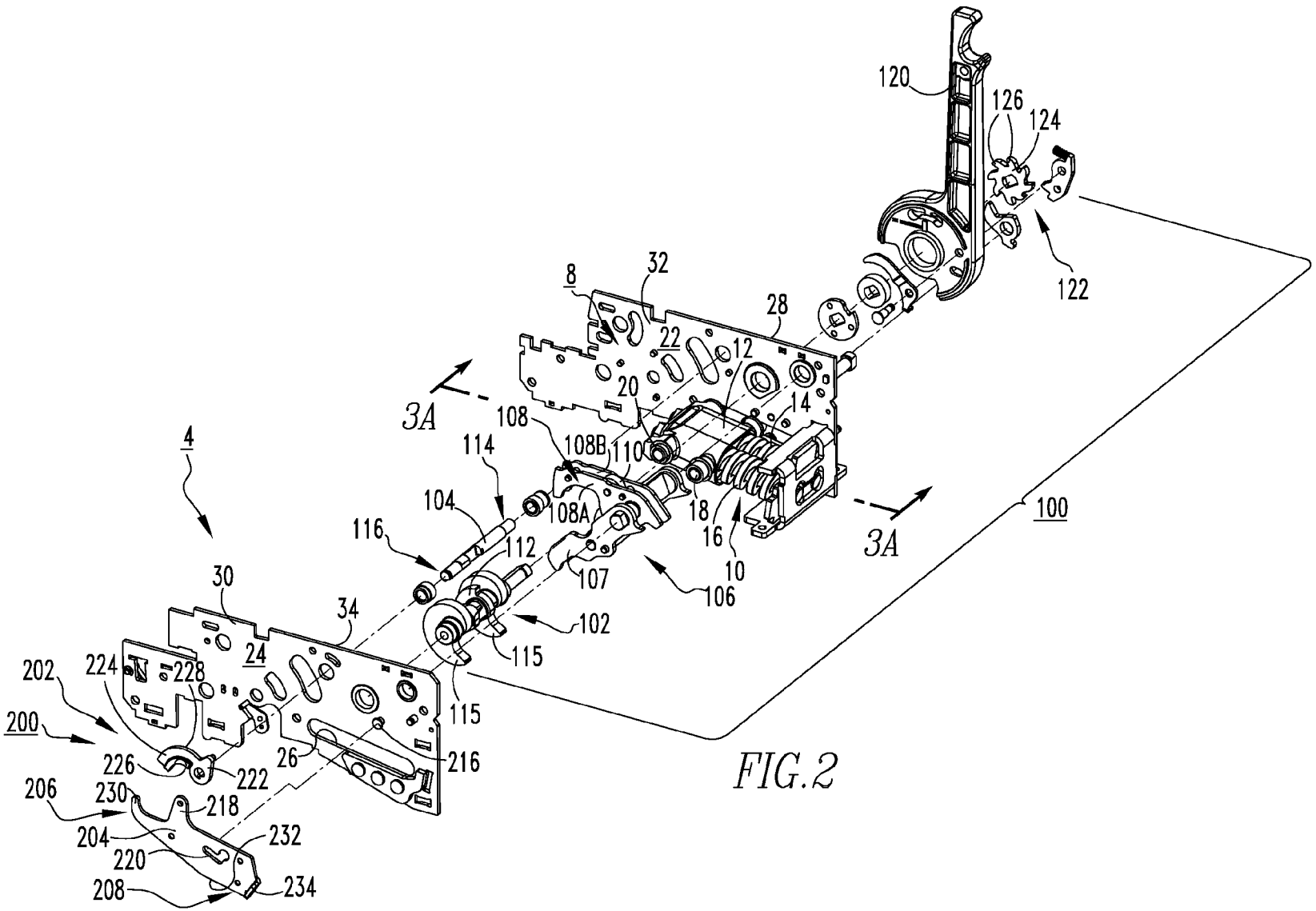
FIG. 2 is an exploded isometric view of the charging assembly and interlock assembly of FIG. 1.

As shown in FIG. 2, the operating mechanism 8 includes a stored energy mechanism 10, which in the example shown and described herein consists of a ram 12, at least one spring 14,16 (two are shown) and a number of rollers 18,20 (two are shown). The charging assembly 100 generally includes a cam shaft 102, a latch mechanism 104, a latch assembly 106 and a charging handle 120. The charging handle 120 is structured to pivot the cam shaft 102, in order to move the cam shaft 102 which, in turn, moves the latch assembly 106 to manually charge the stored energy mechanism 10, in a generally well known manner. For example and without limitation, charging assemblies (e.g., 100) are described in greater detail and commonly assigned U.S. patent application Ser. No. 11/693,198, which is incorporated herein by reference. Specifically, the latch mechanism, which in the example shown and described herein is a D-shaft 104, is pivotable between a first position (FIG. 3C) corresponding to the D-shaft 104 latching the latch assembly 106, and a second position (FIGS. 3A and 3B) corresponding to the D-shaft 104 unlatching the latch assembly 106.

Figure 3C:
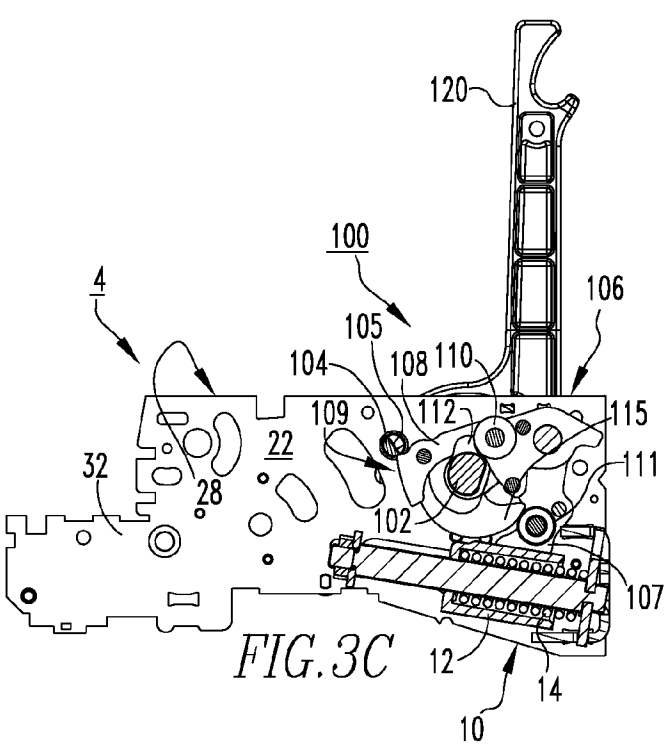
FIG. 3C is a partially sectioned view of the charging assembly and interlock assembly therefor of FIG. 3B, modified to show the components of the charging assembly in their respective positions when the stored energy mechanism has been fully charged.

Continuing to refer to FIG. 2, and also to FIGS. 1 and 4A-4C, it will be appreciated that the example interlock assembly 200 includes a lever 202, which is structured to be coupled to and pivotable with the D-latch 104, and further includes a latch interlock 204, which is pivotably coupled to the circuit breaker housing 4. The latch interlock 204 has first and second opposing ends 206,208, wherein the first end 206 is structured to move the lever 202 to position the D-shaft 104, as desired (described in greater detail hereinbelow). More specifically, the latch interlock 204 is movable between a locked position (FIGS. 1, 4A and 4B), corresponding to the first end 206 of the latch interlock 204 moving the lever 202 to position the D-shaft 104 in the second position (FIGS. 3A and 3B), and an unlocked position (FIG. 4C), corresponding to the first end 206 and the latch interlock 204 moving the lever 202 to position the D-shaft 104 in the first position (FIG. 3C). As will be discussed, unless and until the stored energy mechanism 10 is substantially fully charged, as shown, for example in FIGS. 3C and 4C, the latch interlock 204 is disposed in the locked position (see, for example, FIGS. 1, 4A and 4B), in order that the latch assembly 106 is movable with respect to the D-shaft 104. In this manner, in the event the charging handle 120 is inadvertently released (e.g., without limitation, accidently dropped), for example during a manual charging operation wherein the charging handle 120 is being operated, as depicted in phantom line drawing in FIG. 1, to manually charge the stored energy mechanism 10 (partially shown in FIG. 1), the disclosed interlock assembly 200 resists undesired positive engagement between components (e.g., without limitation, latch assembly 106; cam shaft 102; latch lobe 112), which could be destructive. For instance, absent the disclosed interlock assembly 200, it is possible that, if the charging handle 120 was dropped in the middle of a charging stroke (shown in phantom line drawing in FIG. 1), that the stored energy in the partially charged stored energy mechanism 10 (partially shown in FIG. 1) could cause the cam shaft 102 (FIGS. 2 and 3A-3C) to rapidly rotate rearwardly and slam into a portion (e.g., roller 110, discussed hereinbelow) of the latch assembly 106 (FIGS. 2 and 3A-3C), resulting in damage (e.g., without limitation, bending; fracturing) to these components. More specifically, the charging handle 120 includes a ratchet assembly 122 having a sprocket 124 with a plurality of teeth 126. When the charging handle 120 is operated, the teeth 126 are incrementally engaged as the sprocket 124 rotates, in a generally well known manner. It is the stored energy when the ratchet assembly 122 is between teeth 126 as the charging handle 120 is being operated, which is the primary concern of the invention.

Figure 3B:
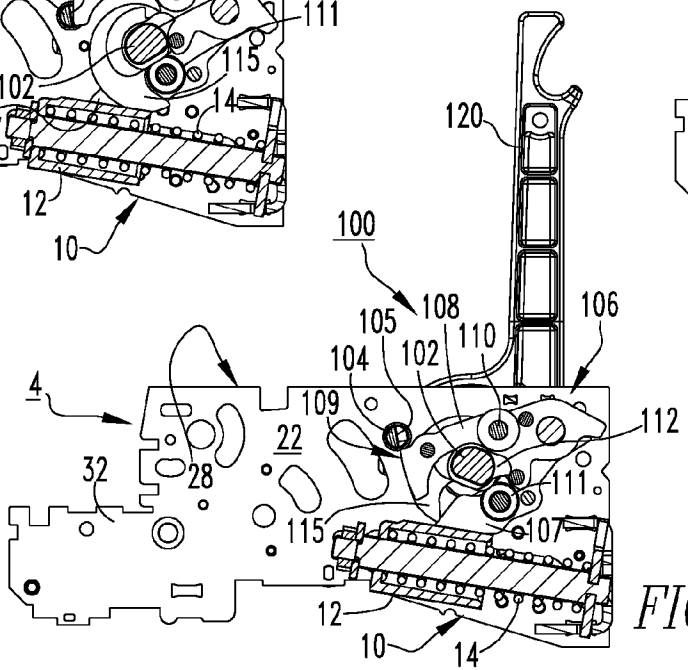
FIG. 3B is a partially sectioned view of the charging assembly and interlock assembly therefor of FIG. 3A, modified to show the components of the charging assembly in their respective positions when the stored energy mechanism has been partially charged.
Figure 3A:
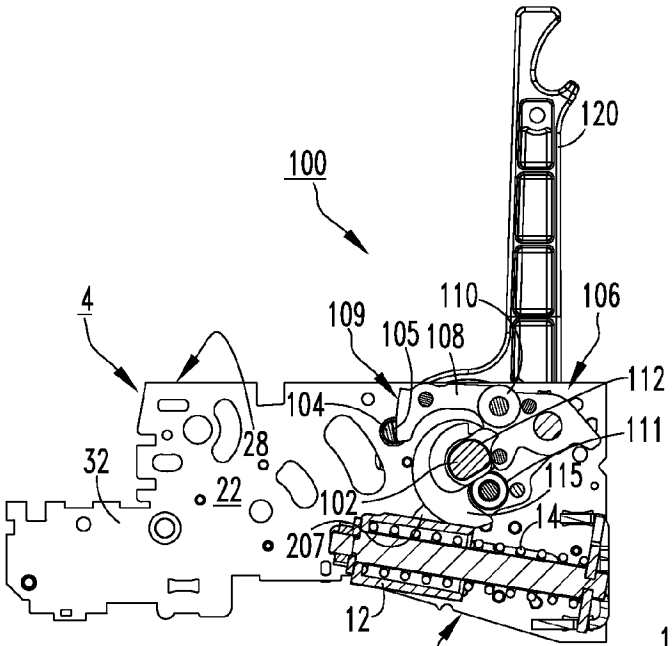
FIG. 3A is a sectional view taken along line 3A-3A of FIG. 2, showing the charging assembly in the discharged position.

The function of the charging assembly 100, as it relates to the disclosed interlock assembly 200 (FIGS. 1, 2 and 4A-4C), will now be discussed with reference to FIGS. 3A-3C. Specifically, the example latch assembly 106 includes a close prop 108 and the aforementioned roller 110. The close prop 108 and, in particular the first end 109 thereof, cooperates with the D-shaft 104. More specifically, when the D-shaft 104 is disposed in the second position of FIGS. 3A and 3B, the first end 109 of the close prop 108 does not engage the D-shaft 104, in order that the close prop 108 is free to pivot with respect thereto. In other words, the flat surface 105 of the D-shaft 104 is positioned such that the first end 109 of the close prop 108 can pivot past D-shaft 104. Conversely, when the D-shaft 104 is disposed in the first position of FIG. 3C, the D-shaft 104 engages the first end 109 of the close prop 108, thereby holding the latch assembly 106 in the latched position, shown. Specifically, the flat surface 105 of the D-shaft 104 is no longer aligned with the first end 109 of the close prop 108 such that the close prop 108 abuts the D-shaft 104 and cannot pivot with respect thereto.

The roller 110 is pivotably coupled to the close prop 108, and is cooperable with a latch lobe 112 of the cam shaft 102 of the charging assembly 100. Specifically, as shown in FIG. 3C, when the stored energy mechanism 10 is fully charged, the latch lobe 112 is fully engaged with the close prop roller 110. Of particular relevance to the disclosed interlock assembly 200 (FIGS. 1, 2 and 4A-4C) is the fact that, when the stored energy mechanism 10 is in the process of being charged, as shown in FIG. 3B, the latch lobe 112 has the potential to recoil (e.g., rapidly turn, for example counterclockwise from the perspective of FIG. 3B) and strike the close prop roller 110. Under such circumstances, as previously discussed, the disclosed interlock assembly 200 (FIGS. 1, 2 and 4A-4C) functions to maintain the D-shaft 104 in its second position, in order that the close prop 108 of the latch assembly 106 is free to move (e.g., pivot) with respect to the D-shaft 104 and with respect to the latch lobe 112 of the cam shaft 102. In this manner, the interlock assembly 200 (FIGS. 1, 2 and 4A-4C) resists positive engagement between the latch lobe 112 and close prop roller 110, and instead permits the latch lobe 112 to freely pivot the close prop 108 in the event the latch lobe 112 inadvertently engages the close prop roller 110, for example and without limitation, in the event the charging handle 120 is accidently dropped, as previously discussed. Accordingly, the disclosed interlock assembly 200 (FIGS. 1, 2 and 4A-4C) advantageously avoids damage that could otherwise be caused to the components (e.g., without limitation, latch lobe 112; close prop 108; roller 110) of the charging assembly 100.

As shown in FIG. 2, certain components of the charging assembly 100 preferably, but not necessarily, include two substantially identical members, which are held in spaced relationship and which move in concert. For example and without limitation, the example close prop 108 consists of substantially identical close prop members 108A and 108B, which are held in spaced relationship and which move in concert. Such use of multiple members (e.g., 108A,108B) is used, for example, to provide added strength to the latch assembly 106 and/or because space considerations do not allow for a single, relatively thick member. Because the multiple members (e.g., 108A,108B) perform the same function, have substantially the same shape, and move in concert, the mechanism which they collectively comprise (e.g., close prop 108) will be simply identified and discussed herein by a single reference number (e.g., 108). For example and without limitation, the first and second members 108A and 108B of the close prop 108 of FIG. 2 are shown and described in FIGS. 3A-3C, merely as close prop 108. It is understood that the description of such close prop 108 applies to both close prop member 108A,108B. It will also be appreciated that other components of the charging assembly 100 and/or circuit breaker 2 (FIG. 1) could be constructed using various laminations, layers or members, which for example and without limitation are sandwiched together (not shown), without departing from the scope of the invention.

Also shown in FIG. 2, is the fact that the example circuit breaker housing 4 includes first and second opposing and spaced apart side sheets 22,24. Each of the first and second side sheets 22 and 24 respectively includes a first side 28 and 30, and a second side 32 and 34. The stored energy mechanism 10 and the latch assembly 106 are disposed on the second side 34 of the second side sheet 24, substantially between the first and second side sheets 22,24, whereas the example interlock assembly 200 is substantially disposed on the first side 30 of the second side sheet 24.

The D-shaft 104 of the example charging assembly 100 includes a first end 114 pivotably coupled to the first side sheet 22, and a second end 116 pivotably coupled to the second side sheet 24. The lever 202 of the example interlock assembly 200 is coupled to the second end 116 of the D-shaft 104 at or about the first side 30 of the second side sheet 24, as shown. In this manner, the lever 202 is structured to move (e.g., pivot) with, but not with respect to, the D-shaft 104.

Figure 4C:
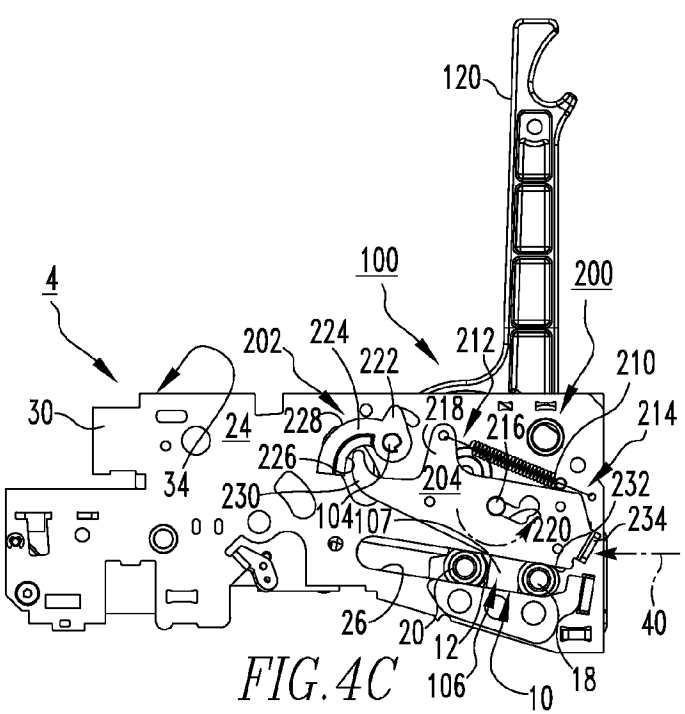
FIGS. 4A-4C are side elevation views corresponding to FIGS. 3A-3C, respectively, showing the components of the interlock assembly in their respective positions when the stored energy mechanism of the charging assembly is discharged, partially charged and fully charged.
Figure 4B:
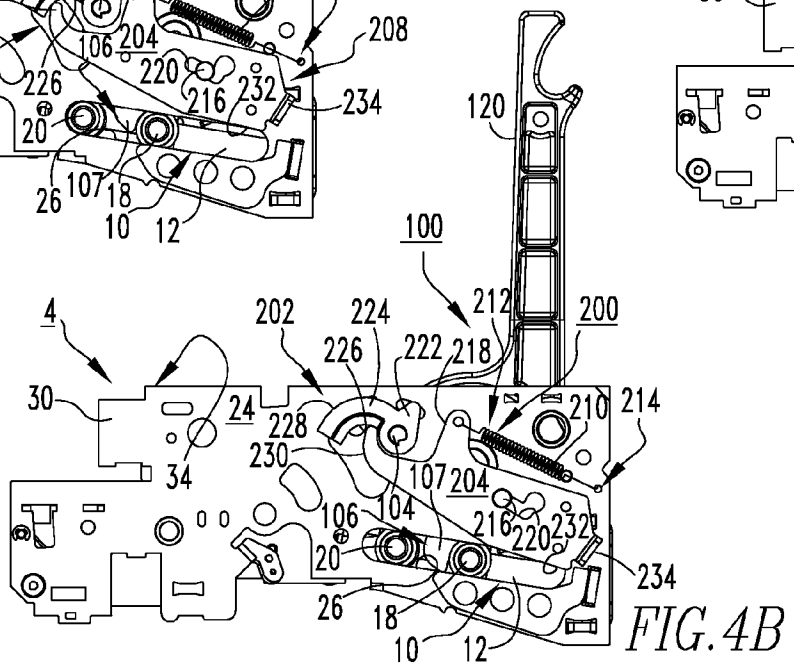
Figure 4A:
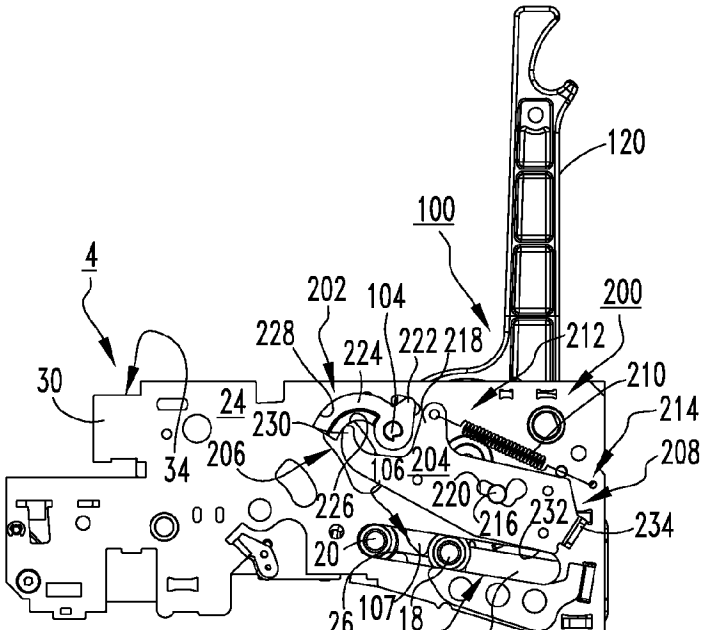

As shown in FIGS. 4A-4C, the latch interlock 204 of the example interlock assembly 200 further includes a biasing element, such as a spring 210, and a pivot pin 216. The pivot pin 216 pivotably couples the latch interlock 204 to the first side 30 of the second side sheet 24. The spring 210 includes a first end 212, which is coupled to a protrusion 218 of the latch interlock 204, and a second end 214, which is coupled to the second side sheet 24, as shown. The spring 210 biases the latch interlock 204 about the pivot pin 216, toward the locked position of FIGS. 4A and 4B. Thus, the spring 210 provides a rotational (e.g., clockwise from the perspective of FIGS. 4A-4C) bias. However, it also provides a translational bias of the latch interlock 204. Specifically, the example latch interlock 204 further includes a slot 220 between the first and second ends 206,208 thereof. The pivot pin 216 is movably disposed in the slot 220, in order that the latch interlock 204 can both pivot (e.g., clockwise and counterclockwise with respect to FIGS. 4A-4C) and translate (e.g., without limitation, left and right, and up and down, from the perspective of FIGS. 4A-4C). Accordingly, as shown in FIG. 4A, it will be appreciated that the two degrees of freedom (e.g., translation; rotation) of latch interlock 204 enable it to be locked even if it is not activated by the position of the pivot pin 216 within the slot 220 in FIG. 4A.

The lever 202 of the example interlock assembly 200 includes a mounting portion 222 and an arcuate portion 224 extending outwardly from the mounting portion 222. The mounting portion 222 mounts the lever 202 to the D-shaft 104 (partially shown in FIGS. 4A-4C; see also FIG. 2) of the charging assembly 100. The arcuate portion 224 includes a concave surface 226 and a convex surface 228, which is disposed opposite the concave surface 226. The first end 206 of the latch interlock 204 of the example interlock assembly 200 is an arcuate hook 230, which extends toward the lever 202 and cooperates with a concave surface 226 of the arcuate portion 224 of the interlock assembly lever 202, as shown in FIGS. 4A-4C.

Continuing to refer to FIGS. 4A-4C, the second side sheet 24 of the circuit breaker housing 4 includes an elongated opening 26. The rollers 18,20 of the ram 12 of the stored energy mechanism 10 are movably disposed within the elongated opening 26, as shown. As partially shown in FIG. 2, it will be appreciated that the opposite side of the ram 12 also includes rollers, which are substantially identical to rollers 18 and 20, and that the first side sheet 22 of the circuit breaker housing 4 also includes an elongated opening (partially shown), which is substantially identical to elongated opening 26 of second side sheet 24. Thus, it will be appreciated that the ram 12 is movably coupled to the circuit breaker housing 4.

The example latch assembly 106 further includes an arm 107 (partially shown in FIGS. 4A-4C; see also FIG. 2), which is structured to engage and move (to the right from the perspective of FIGS. 4A-4C) roller 18 of the ram 12 of the stored energy mechanism 10, in order to charge the stored energy mechanism 10 and move it toward the fully charged position of FIG. 4C. More specifically, as shown, for example in FIGS. 3A and 3C, the cam shaft 102 of the example charging assembly 100 further includes a number of cam lobes 115 (one is shown in the side elevation views of FIGS. 3A-3C; see also the pair of cam lobes 115, shown in the isometric view of FIG. 2), which engage and move the latch assembly 106 and, in particular, an arm roller 111, which is pivotably coupled to arm 107 of the latch assembly 106. The arm 107, in turn, engages and moves the corresponding roller 18 of the ram 12, in order to move (e.g., to the right from the perspective of FIGS. 3A-3C) the ram 12 and thereby charge the closing spring 14 (shown in sectional view in FIGS. 3A-3C; see also first and second closing springs 14 and 16 of FIG. 2) of the stored energy mechanism 10.

The latch interlock 204 of the example interlock assembly 200 further includes a contact edge 232 disposed proximate the second end 208 of the latch interlock 204. When the stored energy mechanism 10 is being charged, as shown in FIG. 4B, a corresponding one of the rollers 18 of the ram 12 of the stored energy mechanism 10 engages the contact edge 232, in order to pivot (e.g., counterclockwise from the perspective of FIG. 4B) the latch interlock 204 about the pivot pin 216, toward the unlocked position (FIG. 4C). Furthermore, when the stored energy mechanism 10 is fully charged, the corresponding roller 18 of the ram 12 fully engages the contact edge 232 of the latch interlock 204, thereby positioning and holding the latch interlock 204 in the unlocked positioned, as shown in FIG. 4C.

The second end 208 of the example latch interlock 204 further includes a tab 234, which protrudes perpendicularly outwardly from the latch interlock 204, and is structured to cooperate with a release member 40 (indicated generally by arrow 40, which is shown in phantom line drawing in FIG. 4C) of the operating mechanism 8 (FIG. 1) of the circuit breaker 2 (FIG. 1). Specifically, when the circuit breaker 2 (FIG. 1) is removed from a cassette (not shown) or a switchgear enclosure (not shown), the release member 40, which is preferably disposed on a levering mechanism (not expressly shown) of the circuit breaker 2 (FIG. 1), but could alternatively be disposed on the cassette (not shown) or switchgear enclosure (not shown), engages and moves (e.g. to the left from the perspective of FIG. 4C) the tab 234 of the latch interlock 204, thereby translating the latch interlock 204 and discharging the stored energy mechanism 10. In this manner, the disclosed interlock assembly 200 also serves the further function of acting as a safety feature to avoid injury to the operator, for example, in order to automatically discharge the stored energy mechanism 10 whenever the circuit breaker 2 is being removed from the cassette (not shown) or switchgear enclosure (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An interlock assembly for a charging assembly of an electrical switching apparatus, said electrical switching apparatus including a housing, separable contacts enclosed by said housing, and an operating mechanism structured to open and close said separable contacts, said operating mechanism including a stored energy mechanism, said charging assembly including a cam shaft, a latch mechanism, a latch assembly and a charging handle, said charging handle being structured to pivot said cam shaft, said cam shaft being structured to move said latch assembly in order to charge and discharge said stored energy mechanism, said latch mechanism being movable between a first position corresponding to said latch mechanism latching said latch assembly, and a second position corresponding to said latch mechanism unlatching said latch assembly, said interlock assembly comprising:

a lever structured to be coupled to and move with said latch mechanism of said charging assembly; and a latch interlock structured to be pivotably coupled to said housing of said electrical switching apparatus, said latch interlock comprising a first end and a second end disposed opposite and distal from the first end, said latch interlock being movable between a locked position corresponding to the first end of said latch interlock being structured to move said lever to position said latch mechanism in said second position, and an unlocked position corresponding to the first end of said latch interlock being structured to move said lever to position said latch mechanism in said first position, wherein, unless and until said stored energy mechanism is substantially fully charged, said latch interlock is structured to be disposed in said locked position, in order that said latch assembly is movable with respect to said latch mechanism.

2. The interlock assembly of claim 1 wherein said latch interlock further comprises a biasing element; and wherein said biasing element biases said latch interlock toward said locked position.

3. The interlock assembly of claim 2 wherein said latch interlock further comprises a pivot pin and a protrusion; wherein said pivot pin is structured to pivotably couple said latch interlock to said housing of said electrical switching apparatus; wherein said protrusion extends outwardly from said latch interlock between the first end of said latch interlock and the second end of said latch interlock; wherein said bias element is a spring; wherein said spring includes a first end and a second end disposed opposite and distal from the first end of said spring; wherein the first end of said spring is coupled to the protrusion of said latch interlock; wherein the second end of said spring is structured to be coupled to said housing of said electrical switching apparatus; and wherein said spring is structured to bias said latch interlock about said pivot pin.

4. The interlock assembly of claim 3 wherein said latch interlock further comprises a slot; and wherein said pivot pin is movably disposed in said slot, in order that said latch interlock is structured to be pivotable and translatable with respect to said housing of said electrical switching apparatus.

5. The interlock assembly of claim 1 wherein said latch mechanism is a D-shaft; wherein said D-shaft is pivotable between said first position and said second position; wherein said lever comprises a mounting portion and an arcuate portion extending outwardly from said mounting portion; wherein said mounting portion is structured to be coupled to said D-shaft; and wherein said arcuate portion has a concave surface and a convex surface disposed opposite the concave surface.

6. The interlock assembly of claim 5 wherein the first end of said latch interlock is structured to cooperate with the concave surface of said arcuate portion of said lever, in order to move said D-shaft between said first position and said second position.

7. The interlock assembly of claim 1 wherein the first end of said latch interlock comprises an arcuate hook; and wherein said arcuate hook extends toward said lever.

8. The interlock assembly of claim 1 wherein said latch interlock further comprises a contact edge; and wherein said contact edge is structured to cooperate with a portion of said stored energy mechanism, in order to pivot said latch interlock toward said unlocked position.

9. The interlock assembly of claim 8 wherein, when said stored energy mechanism is fully charged, said contact edge of said latch interlock is structured to engage said portion of said stored energy mechanism, thereby positioning said latch interlock in said unlocked position.

10. A charging assembly for an electrical switching apparatus, said electrical switching apparatus including a housing, separable contacts enclosed by said housing, and an operating mechanism structured to open and close said separable contacts, said operating mechanism including a stored energy mechanism, said charging assembly comprising:

a latch assembly;

a latch mechanism structured to be movably coupled to said housing of said electrical switching apparatus, said latch mechanism being movable between a first position corresponding to said latch mechanism latching said latch assembly, and a second position corresponding to said latch mechanism unlatching said latch assembly;

a cam shaft structured to move said latch assembly in order to charge and discharge said stored energy mechanism;

a charging handle coupled to said cam shaft, said charging handle being structured to pivot said cam shaft; and an interlock assembly comprising:

a lever coupled to and movable with said latch mechanism of said charging assembly, and a latch interlock structured to be pivotably coupled to said housing of said electrical switching apparatus, said latch interlock comprising a first end and a second end disposed opposite and distal from the first end, said latch interlock being movable between a locked position corresponding to the first end of said latch interlock moving said lever to position said latch mechanism in said second position, and an unlocked position corresponding to the first end of said latch interlock moving said lever to position said latch mechanism in said first position, wherein, unless and until said stored energy mechanism is substantially fully charged, said latch interlock is disposed in said locked position, in order that said latch assembly is movable with respect to said latch mechanism.

11. The charging assembly of claim 10 wherein said latch mechanism is a D-shaft; wherein said D-shaft is pivotable between said first position and said second position; wherein said lever comprises a mounting portion and an arcuate portion extending outwardly from said mounting portion; wherein said mounting portion is coupled to said D-shaft; wherein said arcuate portion has a concave surface and a convex surface disposed opposed the concave surface; and wherein the first end of said latch interlock cooperates with the concave surface of said arcuate portion of said lever.

12. The charging assembly of claim 10 wherein said latch interlock further comprises a contact edge; and wherein said contact edge is structured to cooperate with a portion of said stored energy mechanism, in order to pivot said latch interlock toward said unlocked position.

13. The charging assembly of claim 10 wherein said latch mechanism is a D-shaft; wherein said D-shaft is pivotable between said first position and said second position; wherein said latch assembly comprises a close prop and a roller; wherein said close prop cooperates with said D-shaft; wherein said roller is pivotably coupled to said close prop; wherein said cam shaft comprises a latch lobe; wherein said latch lobe cooperates with said roller; and wherein, when said interlock assembly is disposed in said locked position, said close prop is pivotable with respect to said D-shaft, in order to resist positive engagement between said close prop and said latch lobe.

14. An electrical switching apparatus comprising:

a housing;

separable contacts enclosed by said housing;

an operating mechanism structured to open and close said separable contacts, said operating mechanism including a stored energy mechanism; and a charging assembly for charging said stored energy mechanism, said charging assembly comprising:

a latch assembly, a latch mechanism movably coupled to said housing of said electrical switching apparatus, said latch mechanism being movable between a first position corresponding to said latch mechanism latching said latch assembly, and a second position corresponding to said latch mechanism unlatching said latch assembly, a cam shaft moving said latch assembly in order to charge and discharge said stored energy mechanism, a charging handle coupled to said cam shaft, said charging handle being structured to pivot said cam shaft, and an interlock assembly comprising:

a lever coupled to and movable with said latch mechanism of said charging assembly, and a latch interlock pivotably coupled to said housing of said electrical switching apparatus, said latch interlock comprising a first end and a second end disposed opposite and distal from the first end, said latch interlock being movable between a locked position corresponding to the first end of said latch interlock moving said lever to position said latch mechanism in said second position, and an unlocked position corresponding to the first end of said latch interlock moving said lever to position said latch mechanism in said first position, wherein, unless and until said stored energy mechanism is substantially fully charged, said latch interlock is disposed in said locked position, in order that said latch assembly is movable with respect to said latch mechanism.

15. The electrical switching apparatus of claim 14 wherein said latch mechanism is a D-shaft; wherein said D-shaft is pivotable between said first position and said second position; wherein said lever of said interlock assembly comprises a mounting portion and an arcuate portion extending outwardly from said mounting portion; wherein said mounting portion is coupled to said D-shaft; wherein said arcuate portion has a concave surface and a convex surface disposed opposed the concave surface; and wherein the first end of said latch interlock of said interlock assembly cooperates with the concave surface of said arcuate portion of said lever.

16. The electrical switching apparatus of claim 14 wherein said latch mechanism is a D-shaft; wherein said D-shaft is pivotable between said first position and said second position; wherein said latch assembly comprises a close prop and a roller; wherein said close prop cooperates with said D-shaft; wherein said roller is pivotably coupled to said close prop; wherein said cam shaft comprises a latch lobe;

wherein said latch lobe cooperates with said roller; and wherein, when said interlock assembly is disposed in said locked position, said close prop is pivotable with respect to said D-shaft, in order to resist positive engagement between said close prop and said latch lobe.

17. The electrical switching apparatus of claim 14 wherein said stored energy mechanism comprises a ram, a number of rollers and at least one spring; wherein said housing of said electrical switching apparatus comprises at least one side sheet; wherein said at least one side sheet includes an elongated opening; wherein said number of rollers of said ram are disposed within said elongated opening in order to movably couple said ram to said housing of said electrical switching apparatus; wherein said cam shaft of said charging assembly includes a number of cam lobes; wherein said number of cam lobes engage and move said latch assembly; and wherein said latch assembly engages and moves a corresponding one of said number of rollers of said stored energy mechanism, thereby moving said ram and charging said at least one spring of said stored energy mechanism.

18. The electrical switching apparatus of claim 17 wherein said latch interlock further comprises a contact edge; and wherein, when said stored energy mechanism is substantially fully charged, a corresponding one of said number of rollers of said ram engages said contact edge of said latch interlock, thereby moving said latch interlock toward said unlocked position.

19. The electrical switching apparatus of claim 17 wherein said at least one side sheet of said housing is a first side sheet and a second side sheet disposed opposite and spaced apart from said first side sheet; wherein each of said first side sheet and said second side sheet includes a first side and a second side disposed opposite the first side; wherein said stored energy mechanism and said latch assembly are disposed on the second side of said second side sheet substantially between said first side sheet and said second side sheet; and wherein said interlock assembly is substantially disposed on the first side of said second side sheet.

20. The electrical switching apparatus of claim 19 wherein said latch mechanism is a D-shaft; wherein said D-shaft is pivotable between said first position and said second position; wherein said D-shaft includes a first end pivotably coupled to said first side sheet, and a second end pivotably coupled to said second side sheet;

and wherein said lever of said interlock assembly is coupled to said D-shaft at or about the first side of said second side sheet.

21. The electrical switching apparatus of claim 19 wherein said latch interlock of said interlock assembly further comprises a biasing element and a pivot pin; wherein said pivot pin is pivotably couples said latch interlock to the first side of said second side sheet of said housing of said electrical switching apparatus; wherein said biasing element includes a first end and a second end disposed opposite and distal from the first end of said biasing element; wherein the first end of said biasing element is coupled to said latch interlock; wherein the second end of said biasing element is coupled to said second side sheet; and wherein said biasing element biases said latch interlock about said pivot pin, toward said locked position.

22. The electrical switching apparatus of claim 14 wherein said electrical switching apparatus is a circuit breaker; wherein the second end of said latch interlock of said interlock assembly includes a tab; wherein said tab protrudes perpendicularly outwardly from said latch interlock; wherein said operating mechanism of said circuit breaker includes a release member; and wherein, when said stored energy mechanism is substantially fully charged and said housing of said circuit breaker is moved in a predetermined manner, said release member engages said tab of said latch interlock, thereby translating said latch interlock and discharging said stored energy mechanism.

* * * * *